United States Patent [19]

Magid

[11] Patent Number: 4,776,499

[45] Date of Patent: Oct. 11, 1988

[54] PLASTIC DISPENSING CONTAINER AND METHOD OF MANUFACTURE

[75] Inventor: David J. Magid, Doylestown, Pa.

[73] Assignee: Grow Ventures Corporation, Hoboken, N.J.

[21] Appl. No.: 9,632

[22] Filed: Jan. 14, 1987

Related U.S. Application Data

[63] Continuation of Ser. No. 578,536, Feb. 9, 1984, abandoned.

[51] Int. Cl.[4] ..... B65D 83/14

[52] U.S. Cl. ..... 222/386.5; 222/402.1; 251/353

[58] Field of Search ..... 222/386.5, 402.1, 402.13, 222/402.24, 387, 518, 143; 220/380, 69, 4 B; 206/519, 520, 515; 251/353, 319

[56] References Cited

U.S. PATENT DOCUMENTS 3,168,222 2/1965 Wanderer ..... 222/143 X 4,162,030 7/1979 Capra et al. ..... 222/386.5 X

*Primary Examiner*—Joseph J. Rolla

*Assistant Examiner*—Nils E. Pedersen

*Attorney, Agent, or Firm*—Kenyon & Kenyon

[57] ABSTRACT

A fluid dispensing container and method for its manufacture is disclosed. The container has an upper and lower portion defining an enclosed chamber. The upper and lower portions are sealed together. An expandable pouch for generating pressurizing gas is contained within the enclosed chamber. A dispensing valve is provided housed in a receptacle molded into the upper portion. In one embodiment, a cylindrical guard molded to the upper portion extends downwardly from the receptacle and is disposed around the valve. A cap frictionally secured to the guard retains the dispensing valve in the receptacle and closes off the cylindrical guard. The guard or cap includes suitable apertures for allowing fluid to reach the valve for dispensing the fluid. The guard and cap prevent the expandable bag from interfering with the operation of the dispensing valve. A method of manufacturing the container is also disclosed.

24 Claims, 5 Drawing Sheets

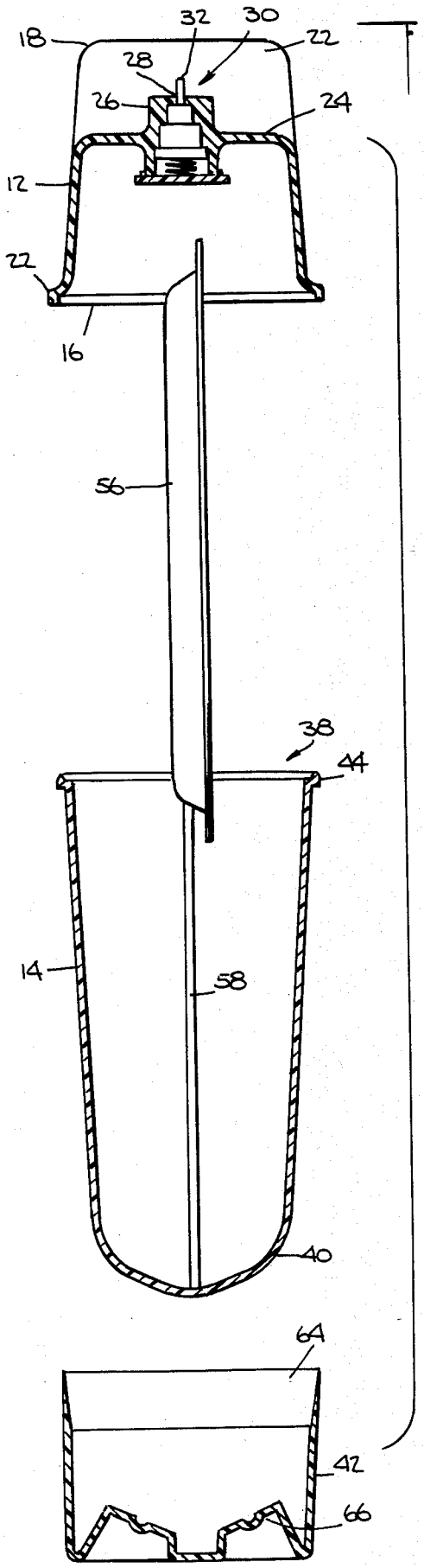
Fig. 6.
Fig. 11.
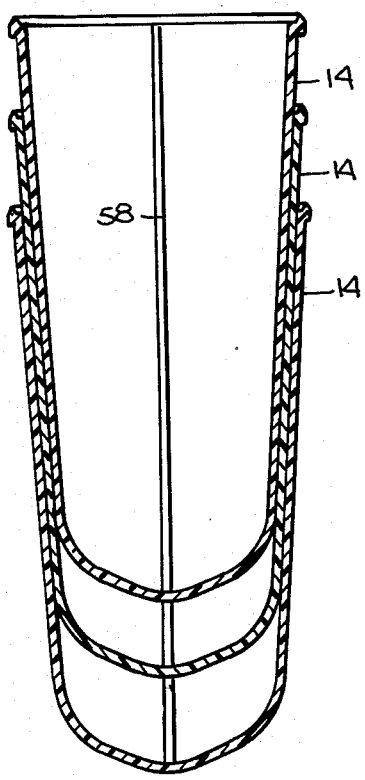
Fig. 7.
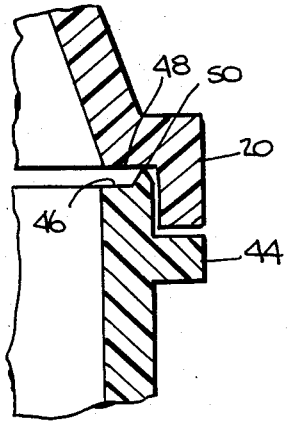

Fig. 8.
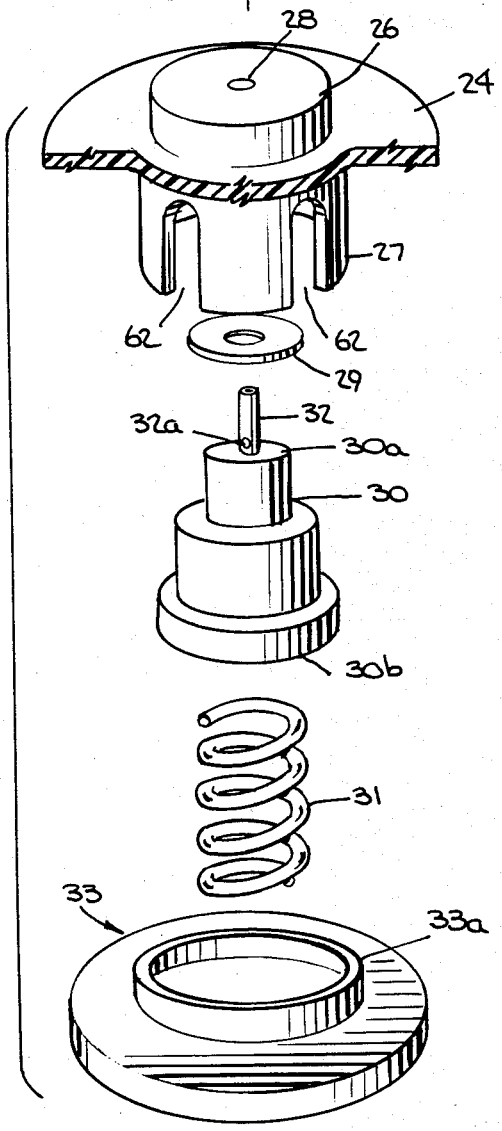
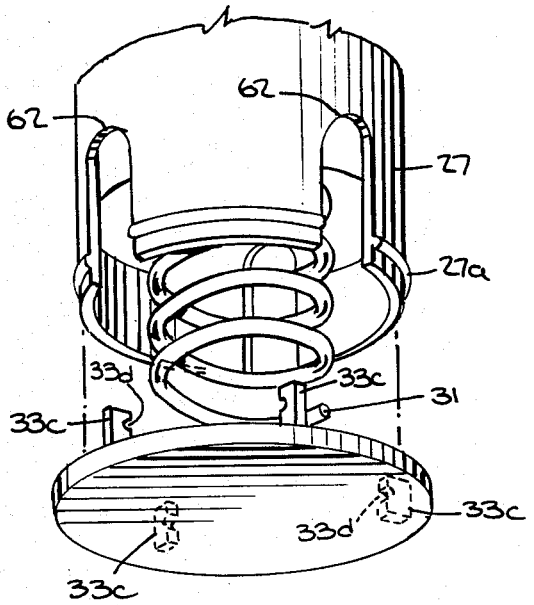
Fig. 9.
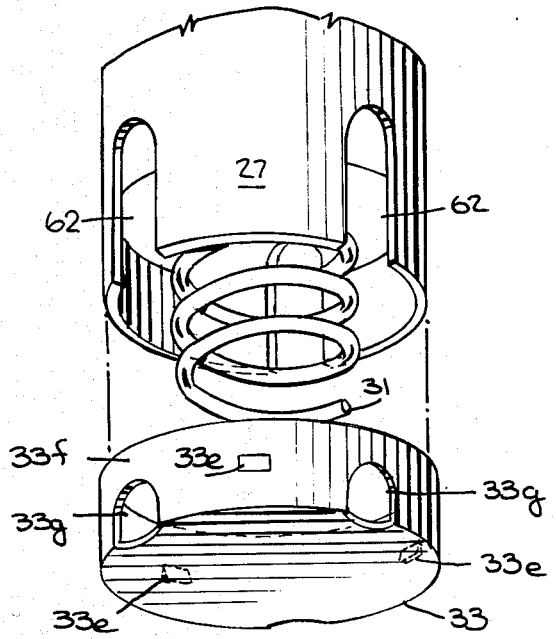
Fig. 9A.

PLASTIC DISPENSING CONTAINER AND METHOD OF MANUFACTURE

This is a continuation to application Ser. No. 578,536 filed Feb. 9, 1984, now abandoned.

BACKGROUND OF THE INVENTION

1. Field of the Invention

The present invention relates to the field of containers for dispensing fluids under pressure. More particularly, the invention relates to a plastic container for dispensing fluids under pressure which is adapted to employ an expandable bag to generate the expulsion pressure within the container, and the method for manufacturing such a container.

2. Background of the Invention

Containers for dispensing fluids under pressure have traditionally fit into two catagories: (1) pressurized containers, such as the common aerosol container, in which constant pressure is exerted on the fluid to be expelled both during use and non-use; and (2) pump-type containers in which the user creates the expulsion pressure during use by manual actuation of a pump apparatus. Commercially suitable pumptype containers have been constructed from a variety of materials, including metals, glass, ceramics and plastics, among others. Since the expulsion pressure is only developed during times of actual use in these containers, complete gas impermeability has not been a design requirement.

In contrast, commercially available pressurized containers have almost exclusively been constructed of metal. By and large, gas propellants within the container have provided the requisite pressure for expelling the fluid contents of the container upon actuation of a valve mechanism. Gas impermeability has therefore been a prime requirement for such containers, and since techniques for forming gas impermeable seals in metal containers have long been successful, metal containers have prevailed.

Metal dispensing containers do possess disadvantages, however, not the least of which are high material costs and manufacturing complexity. Further, such metal containers generally employ mounting cups in which the valve assembly is mounted and which must be crimped to the top portion of the container. Consequently, efforts have been made to produce pressurized dispensing containers made from other materials, especially plastics. To date, however, these efforts have not resulted in an entirely satisfactory alternative to the pressurized metal container.

For example, U.S. Pat. No. 3,140,802 discloses a pressurized dispensing container which includes a collapsible bag and a separate compartment into which an expandable fluid, such as "Freon" is placed. The bag is seated securely in a container which may be constructed of plastic, and attached to the side wall of the container by an adhesive or by heat sealings. (Col. 3, lines 4–7). The lower surface of the bag is adjacent to a "cradle" which forms one wall of the Freon-containing compartment. Holes are formed in the cradle so that the expanded gas can exert pressure on the exterior surface of the bag and cause its contents to be expelled when the valve of the container is actuated. This arrangement represents an attempt to separate the fluid contents to be expelled from the container from the pressure-producing gas propellant and thus reduce the number of sealing locations where the gas can escape.

The seals between the bag and the interior wall of the container and the lower portion of the container thus become critical in assuring that the gas propellant does not escape into the atmosphere.

U.S. Pat. Nos. 3,698,595 and 3,791,557 are representative of an alternative approach to the solution of the gas permeability problems which have heretofore been endemic to pressurized plastic dispensing containers. Both of these patents disclose pressurized dispensing containers in which the pressure is developed on the fluid to be expelled by the contraction of an elastic bladder in which the fluid is contained. the former patent states that one of the advantages of a bladder-type container such as the one disclosed therein is that the container assembly can be made of plastic. (Col. 1, lines 34–38). Bladder-type containers thus solve the gas permeability problem by eliminating gas as a propellant altogether. Quite obviously, the structural integrity and contracting characteristics of the bladder material are limiting factors on the suitably of this type of container for commercial use.

Lastly, British patent publication No. 2,101,225 discloses a plastic dispensing container which, like the common metal aerosol container, uses a gas propellant mixed in with the fluid to be expelled to create the requisite expulsion pressure. In this case, an attempt is made to solve the gas permeability problem by a variety of sealing arrangements between the valve assembly portion of the container and the vessel portion. A metal valve cup is used in the preferred embodiment and sealing is accomplished by crimping the metal over the plastic rim or "bead" of the vessel portion of the container.

SUMMARY OF THE INVENTION

The present invention is an improved plastic pressurized dispensing container in which the need for the cumbersome bag and bladder arrangements and the relatively complex and costly sealing arrangements shown in the prior art is eliminated. Moreover, the present container is made entirely of plastic aside from the valve components and possesses a minimal number of component parts, thus simplifying manufcture. The reduced cost and simplicity of the container of the invention makes it much more suitable for large-scale commercial use than both metal and plastic containers in the prior art.

The plastic container of the invention includes two essential component parts, an upper portion which house the valve mechanism necessary for dispensing of the fluid product, and a lower portion which when sealed to the top means forms the chamber in which the fluid to be dispensed is retained. The dispensing valve is housed in the upper portion of the container in a receptacle formed preferably by injection molding, thus eliminating the need to seat the valve assembly within a mounting cup and crimp the cup to the top of the container in manufacture.

Internal pressure for expelling the contents of the container upon actuation of the valve is provided by an expandable bag located within the chamber in which the fluid to be expelled is retained. The bag contains compositions which when reacted together generate a gas, thereby inflating the bag and causing the bag to exert pressure upon the contents to be expelled from the container. Such an expandable bag is disclosed in U.S. Pat. No. 4,376,500.

To prevent the expansion of the bag from blocking release of any portion of the fluid contents within the chamber, a tube such as that disclosed in the aforementioned U.S. Pat. No. 4,376,500 may be included within the chamber to provide a clear passage for expulsion of the last remaining fluid within the container as the bag reaches its fully expanded condition. Alternatively, a rib may be integrally formed along the portion of the container forming the side wall of the fluid-containing chamber to accomplish the same purpose.

In a similar vein, a valve skirt or closure is provided within the top means of the container around the periphery of the valve mechanism in order to prevent any portion of the expanding bag from obstructing the escape of fluid through the valve. The valve, which may be of a male or female type is mounted within a receptacle molded in the top end of the upper portion of the container. The valve means is retained in place by means of a spring member mounted within the closure and urging the valve against the receptacle wall.

In order to permit the most efficient utilization of space and simplify manufacture, each of the structural components of the container are shaped such that they will nest together in cup fashion. In the assembly process for the preferred embodiment, a cup-like bottom means from a nest stack is fed onto the assembly line and conveyed to a station where the fluid to be dispensed is poured into it and then conveyed to a further station where the expandable bag is dropped into the open mouth of that bottom means. The lower portion of the container into which the expandable bag is inserted is formed with an unobstructed or generally full opening. In this manner, the expandable bag may be inserted without any sideways crushing necessary to facilitate insertion into conventional aerosol containers having narrow openings.

At the next two stations, the top means of the container is first seated onto the open mouth of the bottom means and then welded to the bottom means by a suitable plastic welding process, such as ultrasonic welding, spin welding or friction welding. Once the top means is sealed to the bottom means, assembly is complete. The sealing requirements for such a container are such that the generated seal must be capable of sustaining fluid pressure of at least twenty-five pounds per square inch without any substantial amount of fluid leakage.

Accordingly, it is an object of the present invention to provide a plastic container for dispensing fluids under pressure which includes two essential component parts to be assembled in manufacture.

It is a further object of the invention to provide a plastic container for dispensing fluids under pressure which is adapted to utilize an expandable bag to generate the expulsion pressure within the container.

It is also an object of the invention to provide a plastic dispensing container utilizing an expandable bag expulsion system which includes novel structural features to prevent the fluid to be expelled from being trapped within the container by the expanding bag.

It is yet another object of the invention to provide a plastic dispensing container which is formed from nestable component parts.

It is still a further object of the invention to provide a simple, low cost method for assembling a plastic container for dispensing fluids under pressure.

Still further objects may become apparent to those skilled in the art by reference to the accompanying drawings and detailed description set forth below.

BRIEF DESCRIPTION OF THE DRAWINGS

The present invention is illustrated by way of example and not limitation in the figures of the accompanying drawings in which like reference numerals indicate similar parts, and in which:

FIG. 6 illustrates an exploded view of the structural components of the plastic dispensing container of FIG. 1, and the expandable bag used therewith;

FIG. 7 illustrates a detailed view in cross-section of the interface between the two basic components of the container of the invention, in this case the top and bottom means of the container of FIG. 1;

FIG. 8 illustrates an exploded view of the structural components of the valve assembly and closure means enclosing the valve assembly;

FIG. 9 illustrates an exploded view of an alternative embodiment of the valve assembly closure means;

Figure 1:
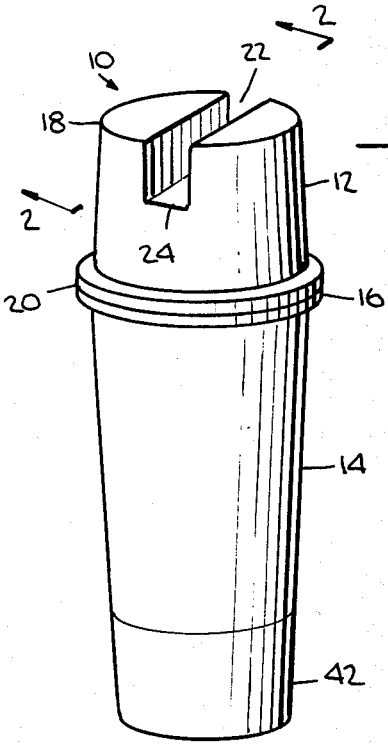
FIG. 1 illustrates a perspective view of the preferred embodiment of a plastic dispensing container in accordance with the invention.
Figure 12:
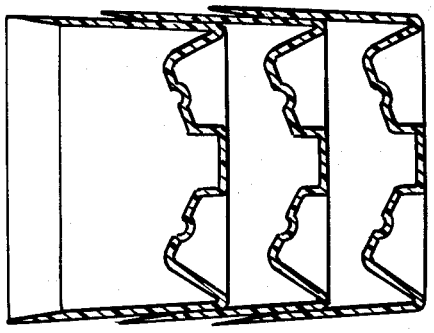
Figure 10:
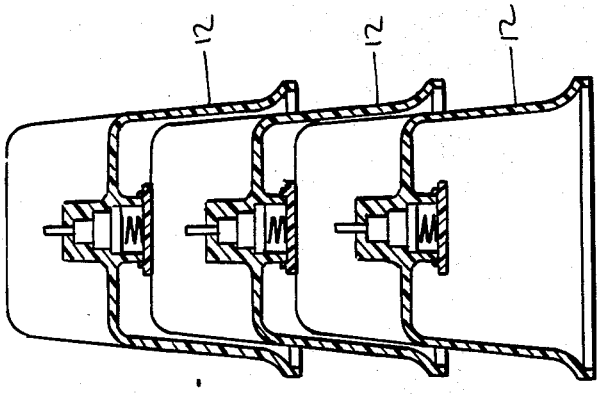
Figure 13:
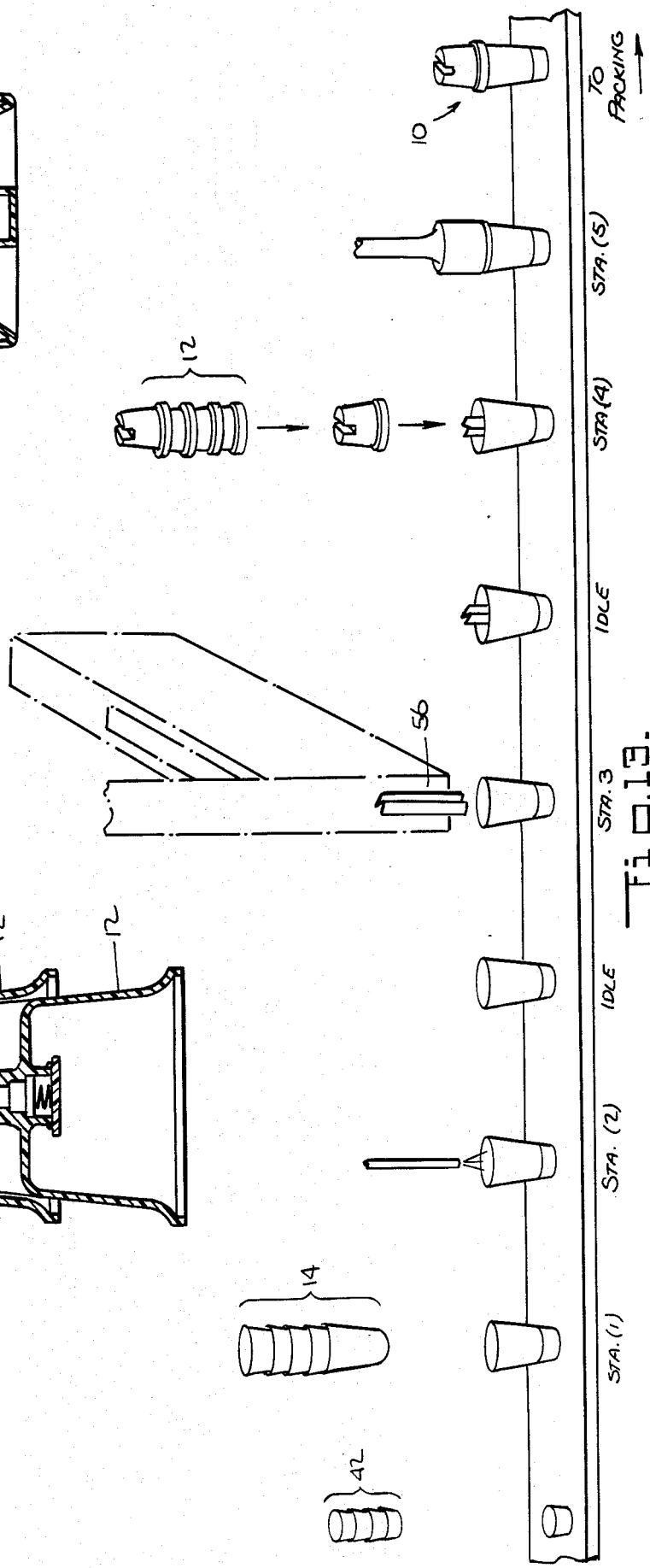
Figure 14:
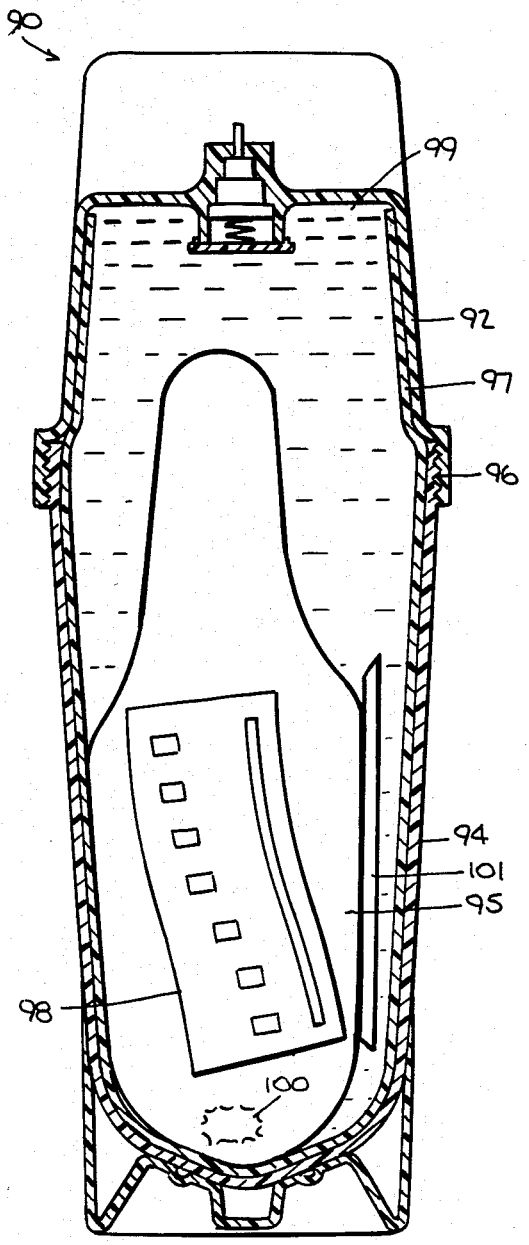

FIG. **9*a*** illustrates an exploded view of a further alternative embodiment of the valve assembly closure means;

FIG. 10 shows a cross-sectional view of a nested stack of top means of the plastic dispensing container of the invention shown in FIG. 1;

FIG. 11 shows a cross-sectional view of a nested stack of bottom means of the plastic dispensing container of the invention shown in FIG. 1;

FIG. 12 shows a cross-sectional view of a nested stack of base cup means of the plastic dispensing container of the invention shown in FIG. 1;

FIG. 13 illustrates the assembly sequence for the preferred embodiment of the plastic dispensing container of the invention; and FIG. 14 illustrates a cross-sectional view of an alternative container embodiment utilizing the top means of the plastic dispensing container.

DESCRIPTION OF THE PREFERRED EMBODIMENT

Referring now to the drawings, the preferred embodiment of the plastic dispensing container of the invention is shown in FIGS. 1–4, 6 and 9–11, and is designated generally by reference numeral 10. FIGS. 1–4 show various views of container 10 in its fully-assembled condition while FIG. 6 shows an exploded view of the structural components of container 10. Container 10 includes two basic structural components, top means 12 and bottom means 14. Top means 12 generally takes the form of a tapered cap, having a wide open lower portion 16 and a narrower upper portion 18. Lower portion 16 tapers outwardly to form the widest dimension of the top means 12, and terminates in a depending flange 20 whose purpose will be hereinafter described.

Upper portion 18 of top means 12 includes a wide transverse groove, or recess, 22 having a substantially flat bottom wall 24. Bottom wall 24 includes a cylindrical housing 26 in the center thereof having an aperture 28 therein.

Cylindrical housing 26, which forms a receptacle for the valve assembly, is integrally molded with the bottom wall 24 of the top 12 and extends upward therefrom. The interior of cylindrical housing 26 is sized to receive a conventional valve assembly which may be either of the male or female type. Extending downward from and integrally molded with bottom wall 24 is a cylindrical guard 27 encircling the valve assembly and which includes, as described in greater detail below, a holding means for retaining the valve assembly within the receptable 26.

Mounted within housing 26 is a spring-loaded aerosol spray valve assembly 30, including valve stem 32, which as mentioned may be either male or female. Any suitable spray head (not shown) may be mounted on valve stem 32 to impart flow characteristics which are appropriate for the fluid being dispensed and the end use to which the fluid is being put. the width dimension of recess 22 is chosen so that the finger of any user of the container may easily gain access to the valve means 30. Recess 22 provides protection for valve means 30 when the container is not in actual use, and also insures that the fluid being expelled from the container will not travel in a direction which the user does not intend.

The manner in which valve assembly 30 is retained within the cylindrical receptacle 26 and guard 27 is best depicted in FIGS. 8 and 9. Valve assembly 30 is positioned within cylindrical housing 26 with the stem 32 aligned to extend through aperture 28 and the seal 29 which abuts against the inside of the top wall of receptacle 26. Valve stem 32 includes a hole 32*a*, so that when the valve stem is depressed by a user, the hole will be disposed below seal 29, allowing fluid to enter the hole to be dispensed. Valve assembly 30 is urged into an abutting sealing relation with receptacle 26 by means of a compression spring 31 which engages the bottom of valve assembly body 30*b*. Locking of the valve assembly 30 within the receptacle 26 is accomplished by means of a cap 33 which is fastened to the guard or skirt 27 and which holds compression spring 31 against valve assembly 30. Cap 33 includes a cylindrical ridge 33*a* which serves to center spring 31. In order to allow fluid material to be dispensed to enter the valve assembly, apertures 62 are provided in guard 27.

Cap 33 may be bonded to the depending skirt 27 by means of spin or sonic welding as will be described below. An alternative mounting of cap 33 to skirt 27 is depicted in FIG. 9. Ears 33*c* are positioned about the periphery of cap 33 and include grooves 33*d* which engage and mate with the rib 27*a* extending about the periphery of skirt 27. An alternative frictional mounting of the cap is depicted in FIG. 9*a*. A plurality of frictional gripping members 33*e* are positioned on the upwardly extending wall 33*f* of cap 33. Gripping members 33*e*, which are preferably metal, engage and bite into the outer surface of skirt 27 and thus hold spring 31 against valve assembly 30. Cap 33 and wall 33*f* thereof may further be provided with holes 33*g* to allow for material flow from the container into the valve assembly.

Alternatively, instead of forming guard 27 integrally with top means 12, guard 27 could be formed integrally with cap 33 and suitable mounting means could be provided on the top means 12, such as those already discussed or variations thereof.

Utilization of the valve assembly and its mounting within the integrally molded receptacle 26 eliminates the need for the valve mounting cups used in the prior art. Further, the assembly described herein eliminates the step of crimping the mounting cup to the container which has heretofore created numerous problems associated with leakage particularly when the container has been dropped.

Bottom means 14 comprises a generally cup-shaped vessel which is tapered from a relatively wide open end 38 to a narrower closed end 40. In the preferred embodiment, closed end 40 is rounded to seat within a base cup means 42 which will be hereinafter described. However, it should be understood that closed end 40 may in the alternative have a flat bottom wall or other configuration that will enable bottom means 14 to stand upright without support.

Figure 2:
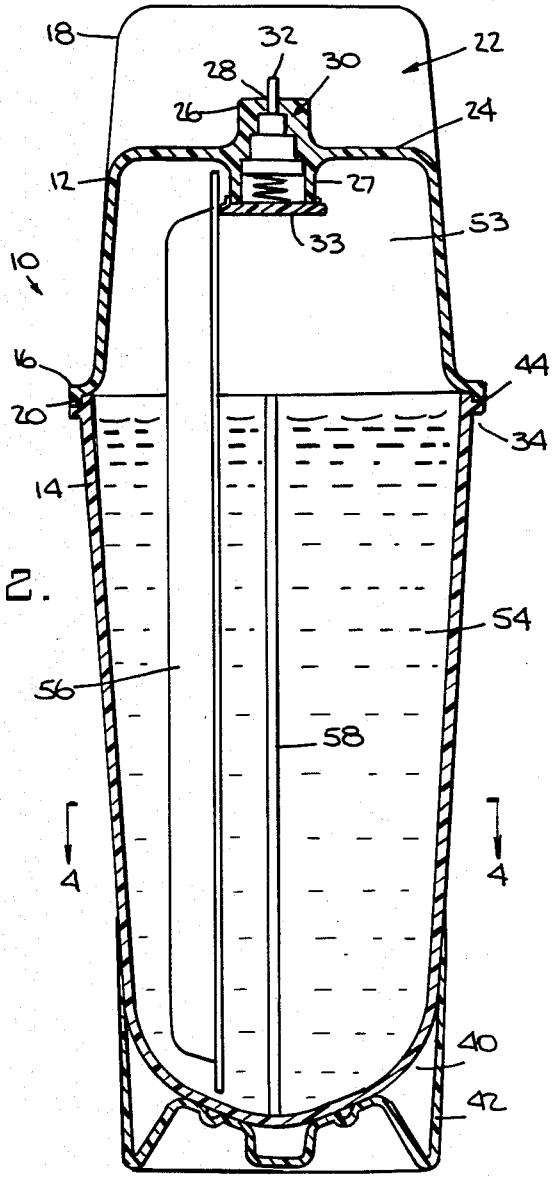
FIG. 2 illustrates a cross-sectional view of the plastic dispensing container of FIG. 1 taken along line 2—2 of FIG. 1, showing the fluid to be dispensed and the expandable bag in place within the interior of the container.
Figure 3:
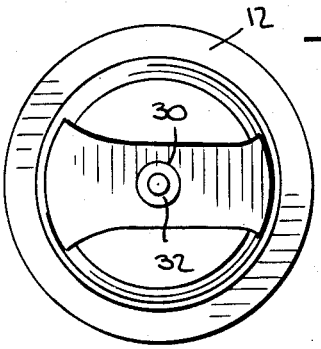
FIG. 3 illustrates a top view of the plastic dispensing container of FIG. 1.
Figure 5:
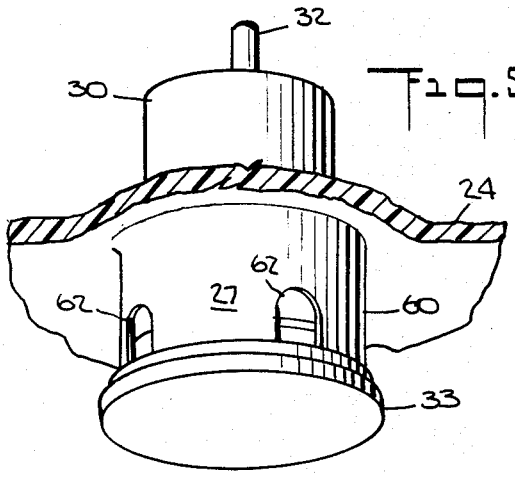
FIG. 5 illustrates a detailed view in perspective of the valve assembly and surrounding structure of the container of the invention.
Figure 4:
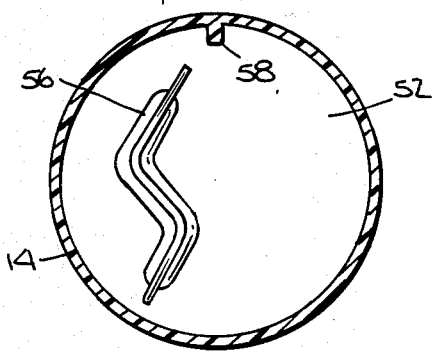
FIG. 4 illustrates a cross-sectional view of the plastic dispensing container of FIG. 1 taken along line 4—4 of FIG. 2.

As is best seen in FIGS. 2 and 7, bottom means 14 includes near its open end 38 a laterally extending shoulder 44 which surrounds the outer periphery of bottom means 14. With reference particularly to FIG. 7, which illustrates the interface between top means 12 and bottom means 14 prior to welding, shoulder 44 is located at a distance below the rim 46 of the open end of bottom means 14 which is approximately equal to the distance which flange 20 of top means 12 extends below rim 48 of top means 12. Located at the edge of rim 46 of bottom means 14 is a bead 50. In the process of welding the top and bottom means of container 10 together, bead 50 is partially melted to form a weld between rim 48 of top means 12 and rim 46 of bottom means 14. When welding is complete, the lower end of flange 20 rests upon the upper surface of shoulder 44. The width dimension of shoulder 44 is chosen to match the width of flange 20 so that a smooth junction is formed when the top and bottom means are welded together.

Effective joining of the top and bottom portions of container 10 may be obtained by spin welding in which the top portion 12 is rotated while bearing against the bottom portion 14. In this manner, an effective seal may be achieved quickly having a tensile strength virtually equal to that of the plastic material. Alternatively, sonic or ultrasonic welding may be employed. In any case, excessive flashing should be trimmed. In a container of the type described utilizing an expandable bag, the sealing of the component parts should be sufficient to withstand an internal fluid pressure of at least 25 pounds per square inch. Such systems have been found to exert pressures in the range of 25 to 90 pounds per square inch.

The sealing of top means 12 to bottom means 14 thus forms within the container a fluid impermeable chamber 53. Fluid 54 is shown located within chamber 53 in FIG. 2, as well as an expandable bag 56 such as that described in detail in the aforementioned U.S. Pat. No. 4,376,500.

In brief, the expandable bag of the above-mentioned patent includes a first group of compartments which are releasably sealed to the internal side wall of the bag and which contain a substance such as citric acid in powdered form or in aqueous solution. Located within the bag external to the first group of compartments is a second substance, such as sodium bicarbonate, which when reacted in the solution with the citric acid component will generate carbon dioxide gas. The solvent medium, water for example, for the aforesaid reaction is contained in a separate rupturable compartment inside the bag. A time release capsule of the citric acid component is located in the bag adjacent to the second component, such that it can be dissolved in the solvent medium when desired to initially activate the gas generating system, i.e., at the point of final assembly of the bag into the dispensing container 10. As the bag expands initially, the first group of compartments is successively unsealed from the side wall thereof, thereby discharging their contents into the solvent containing the second component and maintaining generation of the gas until the bag reaches its fully expanded condition.

As bag 56 expands within chamber 53 of container 10, a greater and greater portion of the volume occupied by fluid 54, and any air initially entrapped within chamber 53, will be displaced until the force exerted by the expanding gases within bag 56 reaches equilibrium with the reactionary force exerted by the fluid 54 and entrapped air within the chamber 53. Initial actuation of the valve mechanism 30 will permit the entrapped air within chamber 53 to escape and allow the bag 56 to expand further to occupy the volume evacuated by the entrapped air. Succeeding actuations of the valve mechanism 30 will permit fluid 54 to be expelled from chamber 53 under the pressure exerted by the expanding bag 56 until bag 56 displaces the entire volume of chamber 53 occupied by fluid 54 and all of the fluid has been expelled.

The expansion of bag 56 within chamber 53 creates the possibility that the bag will expand to the limits of the upper portion of chamber 53 before expanding to the lower limits of chamber 53, thereby trapping fluid in that lower portion. In order to prevent this from happening, the preferred embodiment of container 10 includes along the interior side wall of bottom portion 14 a longitudinal rib 58. Rib 58 will prevent bag 56 from expanding completely to the side walls of bottom portion 14, thereby creating an escape passage for any fluid in the lower portion of chamber 53. The function of rib 58 may also be served by a tube placed within the bottom portion 14 of the container 10 during manufacture. Such a tube is shown and described in the above-mentioned U.S. Pat. No. 4,376,500.

In a similar vein, cylindrical guard 27 which is integrally formed with top means 12 further serves to prevent the expanding bag 56 from obstructing the valve assembly 30. Cylindrical guard 27 includes a plurality of grooves 62 therein to provide passage for fluid 54 to reach the valve assembly 30.

As mentioned earlier, the bottom means 14 of the preferred embodiment of container 10 has a rounded lower portion 40 which seats within a base cup means 42 as shown in FIG. 2. Base cup means 42 includes a bevelled interior wall 64 which is formed to snugly fit against the tapered side walls of bottom means 14. The lower portion of base cup means 42 forms an annular inwardly sloping seat 66 which supports the rounded bottom portion 40 of bottom means 14. Bevelled wall 64 and annular seat 66 cooperate to position bottom cup means 14 in an upright position.

All of the structural components of container 10 hereinbefore described (with the exception of certain internal parts of valve assembly 30 and the spring 31) are formed of any one of a number of synthetic plastics which are both fluid impermeable and strong enough to withstand the pressure developed within the container. Among the plastics from which the container of the invention may be formed are polyethylene terephthalate, polyvinyl chloride and the polyacronitriles. The structural components of the container may be made by any one of a number of processes for forming plastic parts, such as blow molding, extrusion or injection molding.

As shown in FIGS. 10, 11 and 12, top means 12, bottom means 14 and base cup means 42 of the preferred embodiment of container 10 are each shaped so as to be stored in nested stacks. The nestable shapes of top means 12, bottom means 14 and base cup means 42 permit storage of those components prior to manufacture in relatively small areas, thus efficiently utilizing the space available for storage and lowering warehousing costs. The nestable shapes also promote easier feeding of the components on the assembly line during manufacture.

The manufacturing assembly sequence for the preferred embodiment of the container of the invention is illustrated from left to right in FIG. 13. Bottom cup means 42 is first fed from a nested stack onto a moving belt or other conveying device, and then delivered to Station (1). At Station (1), a bottom means 14 is fed from a nested stack and seated in base cup means 42. The resulting subassembly is then delivered to Station (2), where bottom means 14 is filled with fluid which is to be dispensed. After being filled with fluid, the subassembly is conveyed to Station (3), where an expandable bag 56 is inserted from a magazine into bottom means 14. Since the bottom means 14 has a wide opening extending for its entire inner diameter, insertion of the expandable bag 56 is accomplished without requiring crushing. Next, the subassembly is conveyed to Station (4), where top means 12 is fed from a magazine containing a nested stack of that component onto the open end of bottom means 14. At the next Station, Station (5), top means 12 is welded to bottom means 14 by one of a number of suitable plastic welding techniques, such as ultrasonic welding, friction welding or spin welding. The completed container 10 is then conveyed to a packing station and then prepared for shipment.

Appropriate modifications, which will be obvious to those skilled in the art, may be made to the assembly sequence illustrated in FIG. 13 to accommodate containers of different shapes. For example, as previously mentioned, bottom means 14 may have a flat bottom wall enabling it to stand upright without base cup means 42, thereby eliminating base cup means 42 from the assembly sequence. Alternatively, bottom means 14 or top means 12 may have non-nestable shapes which would require them to be placed or fed onto the assembly line by a different method than that shown in FIG. 13.

The cap or top means 12 of the container 10 herein may readily be adapted for use in association with a refill pouch of the type disclosed in applicant's copending application Ser. No. 365,552, filed on Apr. 5, 1982, now U.S. Pat. No. 4,513,884, and entitled "A Dispensing System And A Refill Pouch." With particular reference to FIG. 14, the top means 92 of container 90 is generally of the same construction as that previously described except that a different manner of sealing the two basic components of the container together is provided. The lower portion of top means 92 of container 90 includes an extended depending flange 96 which is provided with screw threads on its interior wall. Mating screw threads are provided on the exterior surface of the upper portion of bottom means 94. An o-ring seal may be utilized in association with the threads, to secure an appropriate seal.

The bottom means 94 again includes the expandable bag 95, depicted in FIG. 14 in a partially expanded state, including pressure generating means 98 and rupturable compartment 100 for initiating gas generation. A tube 101 may be provided so that material to be dispensed at the bottom of bottom means 94 is not "pinched off" by the expandable bag 95. As explained in greater detail in application Ser. No. 365,552, the material to be dispensed is housed within an outer pouch 97, as is also the expandable bag 95. Outer pouch 97 preferably conforms to the shape of bottom means 94 and top means 92, as shown. The top of outer pouch 97 is open to allow fluid material to be dispensed to be in communication with the valve assembly. Such an opening may be made by removal of a tear strip as explained in application Ser. No. 365,552 or by an appropriate puncturing of the outer pouch 97. Once all of the material has been dispensed, container 90 may be opened by removal of the top means 92 and a new refill inserted as described in Ser. No. 365,552, the disclosure of which is herein incorporated by reference.

This invention has been described in terms of specific embodiments set forth in detail, but it should be understood that these are by way of illustration only and that the invention is not necessarily limited thereto. Modifications and variations will be apparent from this disclosure and may be resorted to without departing from the spirit of this invention, as those skilled in the art will readily understand. Accordingly, such variations and modifications of the disclosed invention are considered to be within the purview and scope of this invention and the following claims.

What is claimed is:

1. A container including a pressure generating expandable bag for dispensing fluid contained therein which comprises:

a one-piece lower portion formed of a pressure-resistant fluid-impermeable synthetic plastic material, said lower portion having a bottom closed end, and side walls extending upwardly from said closed end and terminating to form a substantially fully open end;

expandable bag means including pressure generating means therein for dispensing fluid from said container, said expandable bag being adapted to be inserted into the open end of said lower portion of said container without any substantial crushing thereof;

a one-piece upper portion formed of a pressure-resistant fluid-impermeable synthetic plastic material, said upper portion having a top end, side walls extending downwardly from said top end and terminating to form a substantially fully open end sized for mating with said open end of said lower portion and a dispensing valve receiving means integrally molded in said top end and including guarding means extending downwardly from said top for preventing the expandable bag from blocking the release of fluid from said container;

sealing means for joining said lower portion and said upper portion to form a single fluid-impermeable chamber with said guarding means extending into said chamber;

dispensing valve means for releasing fluid from said chamber disposed in said dispensing valve receiving means and protected from interference with said expandable bag by said guarding means; and closure means for retaining said valve means in said dispensing valve receiving means and for providing communication with the fluid to be dispensed, said closure means including cap means having a cylindrical ridge for centering said dispensing valve means and being secured to a lower edge of said guard means, said guard means having openings therein to permit the fluid to pass from said chamber to said valve means, said guard means preventing the expandable bag from blocking said openings.

2. A container in accordance with claim 1 which further includes rib means integrally formed along the interior side wall of said lower portion for preventing said fluid from becoming trapped within said chamber by said expandable bag means as said bag mean expands.

3. A container in accordance with claim 2 which further includes rib means integrally formed along the interior sidewall of said top portion of said container for preventing said fluid from becoming trapped within said chamber.

4. A container in accordance with claim 1 wherein said lower portion is welded to said upper portion forming a seal capable of sustaining a fluid pressure of at least twenty-five pounds per square inch without any substantial amount of fluid leakage.

5. A container in accordance with claim 1 wherein said lower portion has a rounded closed end and said container further includes:

base cup means into which said rounded closed end of said lower portion is disposed, for supporting said lower portion in an upright position.

6. A container in accordance with claim 1 wherein said dispensing valve receiving means comprises an upwardly extending generally cylindrical housing adapted to conform to the body of said valve means, said valve means having an upwardly extending valve stem, said cylindrical housing having an aperture in the upper end thereof to facilitate passing of the valve stem therethrough.

7. A container in accordance with claim 6 which further includes resilient means disposed between said closure means and said valve means for urging said valve means into a sealing relation with an upper end of said cylindrical housing.

8. A container in accordance with claim 7 which further includes frictional holding means securing said guard means and said cap means.

9. A container in accordance with claim 7 wherein said closure means further comprises a plurality of coupling members perpendicular to the surface of said cap means and positioned around the periphery of said cap means, said coupling members having a groove on the inside portion thereof, a rib extending around the outer surface of said guard means, said groove of the coupling members engaging with said rib for mounting the cap means to said guard means.

10. A container in accordance with claim 7 wherein said closure means further comprises a plurality of gripping members positioned on the inside of a cylindrical wall of said cap means, said gripping members frictionally engaging the outer surface of said guard means.

11. A container in accordance with claim 10 wherein said gripping members are metal.

12. A top dispensing member for use with fluid dispensing containers having an expandable bag means therein for exerting pressure on fluid in the container to be dispensed which comprises:

unitary one-piece molded member formed of a pressure resistant fluid-impermeable synthetic plastic material having a top end, side walls extending downwardly from said top end and terminating to form a substantially fully open end sized for mating with an open end of a lower portion of the container and a dispensing valve receiving receptacle means formed in said top end and including depending guard means extending downwardly from said top end into said container for preventing the expandable bag from blocking the release of fluid from said container;

dispensing valve means for releasing fluid from the container, disposed in said receptacle;

closure means for retaining said valve means in said receptacle means and including cap means having a cylindrical ridge for centering said dispensing valve means and being secured to a lower edge of said guard means, said guard means having openings therein to permit the fluid to pass from the container to said valve means, at least one of said guarding mens and said closure means including a surface which said expandable bag means engages upon expansion to restrain the expandable bag means from substantially interfering with said valve means and the dispensing of fluid therefrom; and resilient means disposed between said closure means and said valve means for urging said valve means into a sealing relation with said receptacle means.

13. A top dispensing member in accordance with claim 12 wherein said receptacle means comprises an upwardly extending generally cylindrical housing, the interior of which is adapted to conform to the body of said valve means, said valve means having an upwardly depending valve stem, said cylindrical housing having an aperture in the upper end thereof to facilitate passing of said valve stem therethrough.

14. A top dispensing member in accordance with claim 11 which further includes frictional holding means securing said cap means and said guard means.

15. A container in accordance with claim 12 wherein said closure means further comprises a plurality of coupling members perpendicular to the surface of said cap means and positioned around the periphery of said cap means, said coupling members having a groove on the inside portion thereof, a rib extending around the outer surface of said guard means, said groove of the coupling members engaging with said rib for mounting the cap means to said guard means.

16. A container in accordance with claim 12 wherein said closure means further comprises a plurality of gripping members positioned on the inside of a cylindrical wall of said cap means, said gripping members frictionally engaging the outer surface of said guard means.

17. A container in accordance with claim 12 wherein said gripping members are metal.

18. A container including a pressure generating expandable bag for dispensing fluid container therein which comprises:

a one-piece lower portion formed of a pressure-resistant fluid-impermeable synthetic plastic material, said lower portion having a bottom closed end, and side walls extending upwardly from said closed end and terminating to form a substantially fully open end;

expandable bag means including pressure generating means therein for dispensing fluid from said container, said expandable bag being adapted to be inserted into the open end of said lower portion of said container without any substantial crushing thereof;

a one-piece upper portion formed of a pressure-resistant fluid-impermeable synthetic plastic material, said upper portion having a top end, side walls extending downwardly from said top end and terminating to form a substantially fully open end sized for mating with said open end of said lower portion, said upper and lower portions being shaped so as to be nestable, and a dispensing valve receiving means integrally molded in said top end and including guarding means extending downwardly from said top for preventing the expandable bag from blocking the release of fluid from said container;

sealing means for joining said lower portion and said upper portion to form a single fluid-impermeable chamber with said guarding means extending into said chamber;

dispensing valve means for releasing fluid from said chamber disposed in said dispensing valve receiving means and protected from interference with said expandable bag by said guarding means; and closure means for retaining said valve means in said dispensing valve receiving means and for providing communication with the fluid to be dispensed, said closure means including cap means secured to a lower edge of said guard means, said guard means having openings therein to permit the fluid to pass from said chamber to said valve means, said guard means preventing the expandable bag from blocking said openings;

said closure means comprising a plurality of coupling members perpendicular to the surface of said cap means and positioned around the periphery of said cap means, said coupling members having a groove on the inside portion thereof; and a rib extending around the outer surface of said guard means, said groove of the coupling members engaging with said rib for mounting the cap means to said guard means.

19. A container in accordance with claim 18 wherein said closure means further comprises a plurality of gripping members positioned on the inside of a cylindrical wall of said cap means, said gripping members frictionally engaging the outer surface of said guard means.

20. A container in accordance with claim 19 wherein said gripping members are metal.

21. A top dispensing member for use with fluid dispensing containers having an expandable bag means therein for exerting pressure on fluid in the container to be dispensed which comprises:

unitary one-piece molded member formed of a pressure resistant fluid-impermeable synthetic plastic material having a top end, side walls extending downwardly from said top end and terminating to form a substantially fully open end sized for mating with an open end of a lower portion of the container, said top end and said lower portion having a nestable shape and a dispensing valve receiving receptacle means formed in said top end and including depending guard means extending downwardly from said top end into said container for preventing the expandable bag from blocking the release of fluid from said container;

dispensing valve means for releasing fluid from the container, disposed in said receptacle;

closure means for retaining said valve means in said receptacle means and including cap means having a cyclindrical ridge for centering said dispensing valve means and being secured to a lower edge of said guard means, said guard means having openings therein to permit the fluid to pass from the container to said valve means, at least one of said guarding mens and said closure means including a surface which said expandable bag means engages upon expansion to restrain the expandable bag means from substantially interfering with said valve means and the dispensing of fluid therefrom; and resilient means disposed between said closure means and said valve means for urging said valve means into a sealing relation with said receptacle means.

22. A container in accordance with claim 21 wherein said closure means further comprises a plurality of coupling members perpendicular to the surface of said cap means and positioned around the periphery of said cap means, said coupling members having a groove on the inside portion thereof, a rib extending around the outer surface of said guard means, said groove of the coupling members engaging with said rib for mounting the cap means to said guard means.

23. A container in accordance with claim 21 wherein said closure means further comprises a plurality of gripping members positioned on the inside of a cylindrical wall of said cap means, said gripping members frictionally engaging the outer surface of said guard means.

24. A container in accordance with claim 21 wherein said gripping members are metal.

* * * * *